US011045683B2

(12) United States Patent
Fuzell-Casey et al.

(10) Patent No.: US 11,045,683 B2
(45) Date of Patent: Jun. 29, 2021

(54) WEIGHT LIFTING APPARATUS AND SYSTEM

(71) Applicant: APERTURE INVESTMENTS, LLC, Mercer Island, WA (US)

(72) Inventors: Jacquelyn Fuzell-Casey, Mercer Island, WA (US); Timothy D. Casey, Mercer Island, WA (US)

(73) Assignee: APERTURE INVESTMENTS, LLC, Mercer Island, WA (US)

( * ) Notice: Subject to any disclaimer, the term of this patent is extended or adjusted under 35 U.S.C. 154(b) by 140 days.

(21) Appl. No.: 15/251,768

(22) Filed: Aug. 30, 2016

(65) Prior Publication Data

US 2017/0072251 A1 Mar. 16, 2017

Related U.S. Application Data

(60) Provisional application No. 62/218,503, filed on Sep. 14, 2015.

(51) Int. Cl.
*A63B 21/00* (2006.01)
*A63B 21/06* (2006.01)
(Continued)

(52) U.S. Cl.
CPC .... *A63B 21/4035* (2015.10); *A63B 21/00061* (2013.01); *A63B 21/0601* (2013.01);
(Continued)

(58) Field of Classification Search
CPC ..... A63B 23/1236; A63B 23/0458; A63B 21/0005–00054; A63B 21/0023;
(Continued)

(56) References Cited

U.S. PATENT DOCUMENTS 144,769 A * 11/1873 Kade ..... A47B 17/04 108/11
2,439,027 A * 4/1948 Stanitz ..... A47B 77/022 108/27

(Continued)

OTHER PUBLICATIONS

Harper, Michael. "How Much Weight Is Really Lifted during a Push-up?—Cooper Institute." The Cooper Institute, Mar. 7, 2011, www.cooperinstitute.org/2011/03/how-much-weight-is-really-lifted-during-a-push-up/. (Year: 2011).*

(Continued)

*Primary Examiner* — Jennifer Robertson
(74) *Attorney, Agent, or Firm* — BakerHostetler

(57) ABSTRACT

A weight lifting apparatus including a generally rectangular beam and two handles arranged near its ends. Each apparatus is designed to provide a more equal distribution of heavier weight across the length of the apparatus. Apparatuses may be connected to one another through locking mechanisms. A weight lifting system includes a series of weight lifting apparatuses of varying lengths and weights and is designed to gradually increase a minimum-to-maximum amount of weight. The series of apparatus gives the user a compact, functional weight increment (a gradual increase in weight for muscular strengthening), with comfortable management during the increase in weight, which is useful for a range of bodyweight motions; standing, sitting, bending, and/or on the ground. The weight lifting system also includes a base with handles and a series of additional beams that can be secured to the base to add incremental weights.

34 Claims, 7 Drawing Sheets

(51) Int. Cl.

| | |
|---|---|
| ***A63B 21/072*** | (2006.01) |
| ***A63B 23/12*** | (2006.01) |
| ***A63B 23/035*** | (2006.01) |
| ***A63B 23/02*** | (2006.01) |
| ***A63B 71/06*** | (2006.01) |
| ***A63B 23/04*** | (2006.01) |

(52) U.S. Cl.
CPC ..... *A63B 21/072* (2013.01); *A63B 23/03525* (2013.01); *A63B 23/1209* (2013.01); *A63B 21/0603* (2013.01); *A63B 23/0211* (2013.01); *A63B 2023/0411* (2013.01); *A63B 2071/0694* (2013.01); *A63B 2209/10* (2013.01); *A63B 2210/00* (2013.01)

(58) Field of Classification Search
CPC ..... A63B 21/06; A63B 21/072–075; A63B 21/4035; A63B 71/0036
USPC ..... D21/680
See application file for complete search history.

(56) References Cited

U.S. PATENT DOCUMENTS 2,487,509 A * 11/1949 Baker ..... H04B 1/086 174/113 R
4,351,525 A * 9/1982 Rozenblad ..... A63B 23/12 482/141
4,610,448 A * 9/1986 Hill ..... A63B 23/03533 482/141
5,205,802 A * 4/1993 Swisher ..... A63B 21/00047 482/100
5,226,868 A * 7/1993 Montgomery ..... A63B 21/4035 482/141
5,716,305 A * 2/1998 Selsam ..... A63B 21/00047 482/106
5,954,619 A * 9/1999 Petrone ..... A63B 71/0036 482/104
6,129,651 A * 10/2000 Denaro ..... A63B 21/00047 482/141
7,896,786 B1 * 3/2011 Osbourne ..... A63B 21/0552 482/122
2005/0148448 A1 * 7/2005 Mersch ..... A63B 21/00047 482/141
2010/0261590 A1 * 10/2010 Fares ..... A63B 21/00047 482/131
2012/0040811 A1 * 2/2012 DeTore ..... A63B 21/00047 482/141
2012/0283073 A1 * 11/2012 Zabel ..... A63B 21/0603 482/93
2013/0316880 A1 * 11/2013 Bosse ..... A63B 21/0728 482/107
2014/0100090 A1 * 4/2014 Lima ..... A63B 23/1236 482/139
2015/0024907 A1 * 1/2015 Ross ..... A63B 21/1636 482/39
2016/0346587 A1 * 12/2016 Birt ..... A63B 21/072

OTHER PUBLICATIONS

IKEAhackers, "Kitchen Island with drawers: An Ikea Hemnes hack", Published Jan. 13, 2014, https://www.ikeahackers.net/2014/01/hemnes-kitchen-island-3.html (Year: 2014).*

* cited by examiner 700
702
706
704

702
704
706
100

WEIGHT LIFTING APPARATUS AND SYSTEM

CROSS REFERENCE TO RELATED APPLICATIONS

This application claims benefit under 35 U.S.C. § 119(e) of Provisional U.S. Patent Application No. 62/218,503, filed Sep. 14, 2015, the contents of which is incorporated herein by reference in its entirety.

TECHNICAL FIELD

The present disclosure pertains to the field of physical fitness, and more particularly to a weight apparatus for use in supplementing bodyweight exercises and/or other strength training exercises.

BACKGROUND

Typical weights include barbells, dumbbells, kettlebells and the like. Barbells typically include a single rounded metal bar, of up to 7 feet in length, with loading areas on each distant end for holding one or more weights, typically in the shape of a disk or plate. Bar sizes vary between 1-3 inches, although typically sizes are between 1-1.2 inches. Variations of the bar include an S-shaped bar called an EZ curl bar that is typically used for curls, two parallel handles mounted within a cage that is typically used for tricep extensions, and a bar with a diamond-shaped section in the middle of the bar called a "trap" bar that is typically used for deadlifts and shrugs. The bars are typically gripped by both of a user's hands held at different positions along the bar depending on the selected exercise. Barbells are found in almost every weight room and are tailored for people looking to build larger muscles by doing a small number of repetitions with heavier weights rather than people interested in doing a larger number of repetitions with lower weights.

Dumbbells are smaller versions of barbells, typically no more than a foot or so in length, that are designed to be gripped by only a single hand. A single dumbbell may be used for some exercises or two identically weighted ones for other exercises. Dumbbells may have adjustable weights, like most barbells, where one or more weights may be added to each end of the bar. Dumbbells may also be fixed weights, ranging from as little as 1 pound to as much as 50 pounds or more. Dumbbells can also include adjustable systems that allow the weights to be adjusted by turning a dial or moving a selector pin, rather than adding or removing weight plates.

A kettlebell is a cast-iron or cast steel weight, with an added handle. The weight is typically shaped like a cannonball or cowbell while the handle is a closed loop, rounded bar (similar to the barbell or dumbbell handle in size) attached to the weight. Kettlebell exercises typically involve swinging the kettlebell or using the kettlebell to perform snatch exercises and clean and jerk exercises.

Each of the above weight lifting systems typical situates most of the weight in the palm of a user's hand during an exercise. The pounds per square inch concentrated on the hands can be significant, making the systems ungainly and difficult to use for many people. Moreover, many bodyweight exercises require a wide range of motion (e.g., sit-ups, squats, step-ups, and other bending motions) that can be difficult to perform while holding a barbell, dumbbell or kettlebell. For at least these reasons, many people exercise with less weight than might be optimal, or entirely avoid incorporating weight training into a workout routine because of the shortcomings of these traditional weight systems.

Alternative types of weights such as weighted cylindrical bars and medicine balls have also been used for different exercises. Such weights do a marginally better job of distributing weight across the entire spectrum of a user's upper body, but can be difficult to grip because they lack handles or other suitable means to firmly grasp the weight. As such, they can be difficult to use in bodyweight workouts. Bodyweight workouts can be performed with or without weights and frequently require a great deal of movement by the participant.

There is therefore a need for a weight lifting apparatus and system that offers an alternative to the traditional weight systems, and in particular one that more equally distributes the weight across the entire apparatus, while remaining easy to pick up and hold during an active exercise.

SUMMARY

A weight lifting apparatus according to embodiments of the present application comprise one or more weighted rectangular beams or elongated shapes, each with two handles. The beams can be consistent in size along the entire length, width and thickness, or have varying sizes, such as different thicknesses, so as to more evenly distribute the weight of the apparatus, taking into account the weight of the handles. The two handles can be equally spaced along the beam and spaced apart to provide a wide grip and to more equally distribute weight across a user's body during exercises.

A weight lifting system according to embodiments of the present application comprises a plurality of weight lifting apparatuses of increasing weight and length that enable the apparatuses to be used for a variety of exercises and allow users to progress through different apparatuses either as they get stronger or as they perform different exercises.

Individual weight lifting apparatuses, or a system comprising multiple apparatuses of varying length and weight, could be advantageously used by people that, for example, have smaller statures or are new to weight lifting. By using weight lifting system, users may be able to use heavier weights during various exercises, such as bodyweight exercises, for more effective weight training, injury recovery, and physical therapy.

DETAILED DESCRIPTION OF ILLUSTRATIVE EMBODIMENTS

Figure 1A:
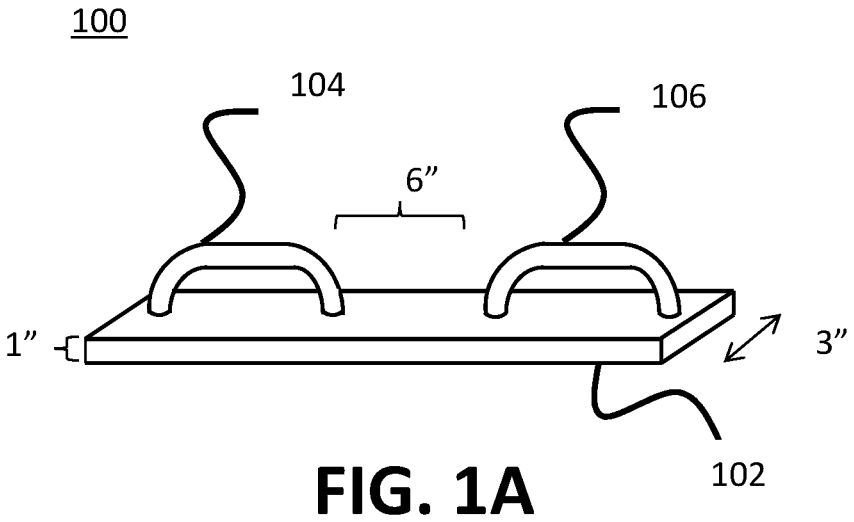
FIG. 1A is a perspective view of a weight lifting apparatus according to one embodiment of the present disclosure and with exemplary dimensions labeled.

A weight lifting apparatus and system comprising a plurality of apparatuses or elongated structures that are designed to spread the weight of each apparatus over the length of the apparatus and give a user a compact and functional weight for certain tight movement exercises and more elongated and heavier weights for other exercises. While the apparatuses are primarily designed for bodyweight type exercises (bodyweight workouts can be performed with or without weights), the apparatuses may be readily used in a wide variety of other exercises. A weight lifting apparatus in accordance with the present application further provides a progressive weight system that is particularly useful for a range of bodyweight motions such as crunching, squatting, twisting and bending as may be required for a wide variety of exercises. Most weight lifting systems are primarily made with strong men and women in mind, such as body builders, competitive weight lifters, athletes, etc., but many other types of people would benefit by adding weight to their exercises if they could do so in a reasonable and comfortable manner. A weight lifting apparatus and system, as described herein, is primarily designed for people who want to add weights to their exercises and to add more weight to accommodate different types of exercises. At the same time, the apparatuses may be shaped so that they are easy to pick up and hold and can be held in a variety of ways that allow any users to comfortably hold the weight to their bodies while performing exercises without concentrating most of the weight of the apparatus in the palm of their hands at all times.

By better distributing balanced weight across all sectors of a weight lifting apparatus, in accordance with the present application, users may be able to employ significantly heavier weight than may be possible with existing weight lifting systems. For example, heavily weighted barbells do not distribute the weight along the length of the bar. Rather, substantially all of the weight is gathered at the ends, which may lead to users tilting and losing their balance as they attempt to lift heavier weights. By distributing the weight along substantially the entire length of the apparatus, the user may be able to more comfortable and safely lift much heavier weights. A distributed weight lifting apparatus may therefore enable smaller framed or less muscled persons to work with heavier weights. The weight lifting system would also be a viable alternative for people recovering from injury or doing physical therapy to improve movement and range. Likewise, young people or other people who are just learning how to lift weights and/or those interested in adding HIIT (High Intensity Interval Training) into their workout routines may find the distributed weights described herein more functionally appropriate. The system may also enable stronger people (i.e., frequent users of traditional weights) to lift heavier weights in a more comfortable and safe manner.

With reference to FIGS. 1A, 1B, 1C, 2A, 2B, 3A, 3B, 4A and 4B, a weight lifting system includes a weighted beam, plank or other elongated shape 102 with two attached handles 104 and 106. In an embodiment, the beam 102 is generally rectangular in shape and has a weight, a width, a thickness, and a length. In the side view illustrated in each of FIGS. 1A, 1B, 1C, 2A, 2B, 3A, 3B, 4A and 4B, the beam 102 has a length defined along an axis extending between the left and right sides of the page, a width defined along an axis extending into the page, and a thickness defined along an axis extending between the top and bottom of the page. In one embodiment illustrated in FIGS. 1A and 1B, the beam 102 has a width of approximately 3 inches, a length of approximately 24 inches, and a thickness of approximately 1 inch. FIGS. 2A, 2B, 3A, 3B, 4A and 4B illustrate generally similar weight lifting apparatuses that differ only in their length and the relative location of the handles.

Again, referring to FIGS. 1A, 1B, 1C, 2A, 2B, 3A, 3B, 4A and 4B, the beams 102 generally have three sets of sides: opposing top and bottom sides (i.e., the planes formed by the width and length), opposing short sides (i.e., the planes formed by the width and thickness), and opposing long sides (i.e., the planes formed by the length and thickness). In order to make the apparatus more durable, it may be desirable to use hardened metals, such as steel to form the beam and handles, but steel can be quite heavy. For example, 1.5 inch diameter hot rolled steel rounds weigh 6.0008 pounds/foot and 1.25 inch diameter hot rolled steel rounds weigh 4.172 pounds/foot. If steel rounds of either size were used for the almost 12 inch long bent handles, the handles alone will add more than 8 to 12 pounds of weight to each apparatus.

To prevent an apparatus from being over-weighted towards the ends, and to more evenly distribute the weight along the entire length of the beam, the thickness of the beam 102 may be reduced in the sections 108 of the handles 104 and 106 and thicker in the section 110 between the handles 104 and 106. FIG. 1C illustrates an embodiment in which the thickness of the beam 102 varies along its length to account for the weight of the handles 104 and 106. For example, if the desired weight of one apparatus is 20 pounds, and the handles 104 and 106 weigh a total of 8 pounds (4 pounds each), then the beam 102 cannot weigh more than 12 pounds. To more evenly distributed the total weight along the length of the apparatus, the beam 102 could be divided into three sections, two sections 108 in the area of the handles and one section 110 between the handles, where the weight of the beam in the sections 108 is 2.66 pounds (plus 4 pounds for each handle equals 6.66 pounds total for each section 108) and the weight of the beam in the section 110 is 6.66 pounds, resulting in a total weight of 19.98 pounds. Of course, a wide range of different compositions of materials may be used to make the apparatuses, including different parts using different materials (with one metal allow used for the handles and different alloys used for the beam), so that changes to the thickness of the beam 102 may or may not be necessary depending on the materials used.

In one embodiment, the beam 102 has contoured or rounded edges. Rounded edges reduce the possibility that a user could be injured by a sharp corner of the beam 102 and reduce the possibility that the apparatus could damage the exercise environment if dropped, bumped into something, etc. In yet another embodiment, the apparatus could be coated in a plastic, neoprene, synthetic rubber, or other coating to further prevent injury and damage, and to improve the comfort of the user.

As illustrated in FIGS. 1A, 1B, 1C, 2A, 2B, 3A, 3B, 4A and 4B, the weight lifting apparatuses have first and second handles 104 and 106 attached to the beam 102. In a preferred embodiment, the handles 104 and 106 are identical, although they could be made asymmetric to facilitate use in a specific exercise or for a specific user. Each handle 104 and 106 may have a generally circular cross section and attach to the beam 102 in two places. The handles are designed to be gripped one in each hand by a user during exercises with the apparatus. The handles may vary in cross section or taper in shape for increased comfort in use. Each handle includes a grip portion and one or more connector portions, wherein the grip portion can be substantially parallel to the length of each beam and wherein the one or more connector portions can connect substantially perpendicular to each beam. In an embodiment, the handles may be substantially parallel to the length of the beam in the area where the user would grip the handles. The handles may further include a grip, such as a series of ridges, bumps, and/or depressions, so as to improve a user's control over the beam and to prevent a user's hands from slipping in the presence of sweat. Each area may have a first end and a second end and be coupled to a first bend having a first end coupled to the first end of the grip and a second end coupled to the beam, and a second bend having a first end coupled to the second end of the grip and a second end coupled to the beam.

FIGS. 1A, 1B, 1C, 2A, 2B, 3A, 3B, 4A and 4B illustrate roughly U-shaped handles 104 and 106 with an overall width of approximately 8 inches. As depicted, the handle has an interior width of approximately 6 inches where it extends generally parallel to the top side of the beam (i.e., where a user would grip the handle). The figures are not intended to be limiting, and different shapes and sizes for the handles could be utilized. For example, in another embodiment, the handles could be made proportionately smaller or larger, possibly taking into consideration the likely size of the intended user or the weight of the material used to construct the handles and beam. They could also be made wider in order to give the user a greater range of hand placements to be selected depending on the exercise. For example, the handles could be longer than 8 inches on longer or heavier apparatuses. In another embodiment the handles could have a more angular or a more circular shape. In another embodiment they could attach to the beam in one, or more than two, places. In yet another embodiment, the beam may include a depression or hollowed out area formed in the beam below each handle to allow more space for a user's hand to grip the handle or more evenly distribute the weight along the length of the apparatus.

In an embodiment the handles 104 and 106 are equally spaced along the top side of the beam 102. In such an embodiment, the handles are attached to a top side of the beam and extend parallel to the length of the beam, are centered along the width of the beam, and are arranged closer to the short sides of the beam than to each other. Moreover, the handles are arranged collinearly with respect to each place that they connect to the top side of the beam.

In an embodiment, the handles 104 and 106 may primarily be intended for enabling a user to lift the beam 102 from the ground or a storage rack. To perform an exercise, the user may then grip the beam 102 directly and not use the handles at all. For some exercises, the user may hug the apparatus to the user's body and only use the handles, if at all, to keep the apparatus pressed tightly to the user. In other exercises, the user may use the handles to place the apparatus directly on their shoulders, then place their hands at some point along the length of the apparatus, but not necessarily on the handles, to hold the apparatus in place while performing an exercise, such as a squat. For other exercises, the user may keep their hands on the handles while performing the exercise or combine their hand holds with support from other parts of their bodies to help distribute the weight. Regardless of whether the user employs the handles during an exercise, the weight of the apparatus is still more distributed along the length of the apparatus than with any other type of existing weight lifting system. To further, more evenly, distribute the weight along the length of the apparatus, the handles may be made of the lightest material possible for its intended purpose.

Figure 1B:
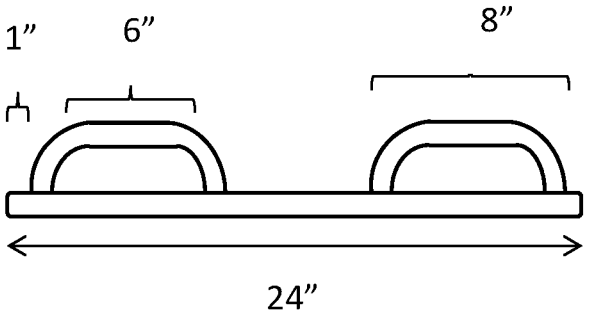
FIG. 1B is a side view of a weight lifting apparatus according to one embodiment of the present disclosure and with exemplary dimensions labeled.
Figure 1C:
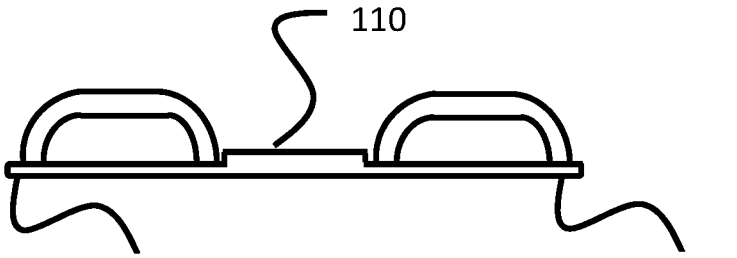
FIG. 1C is a side view of a weight lifting apparatus according to another embodiment of the present disclosure.
Figure 2A:
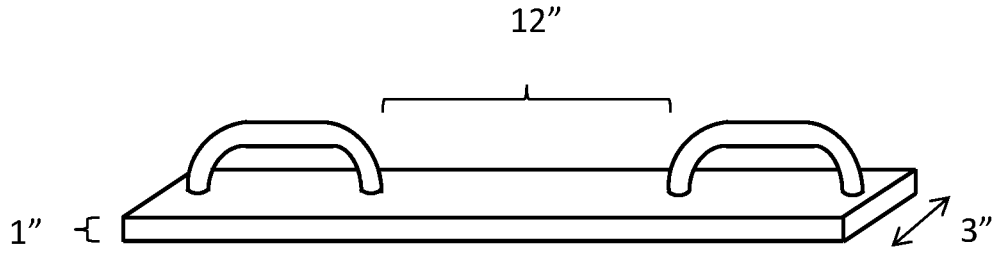
FIG. 2A is a perspective view of another weight lifting apparatus according to an embodiment of the present disclosure that is longer than the weight lifting apparatus illustrated in FIGS. 1A and 1B, and with exemplary dimensions labeled.
Figure 2B:
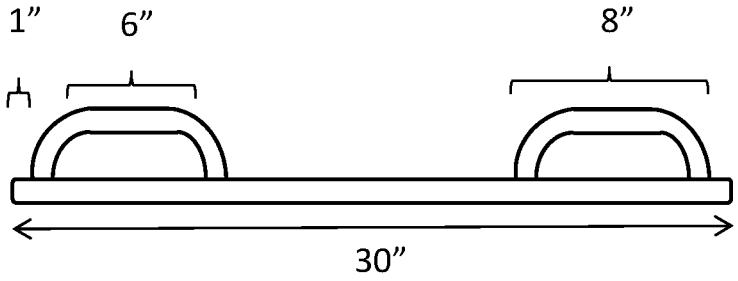
FIG. 2B is a side view of another weight lifting apparatus according to an embodiment of the present disclosure that is longer than the weight lifting apparatus illustrated in FIGS. 1A and 1B, and with exemplary dimensions labeled.
Figure 3A:
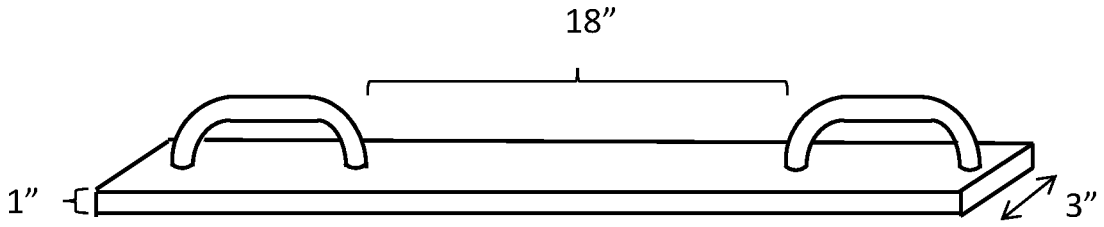
FIG. 3A is a perspective view of another weight lifting apparatus according to an embodiment of the present disclosure that is longer than the weight lifting apparatus illustrated in FIGS. 2A and 2B, and with exemplary dimensions labeled.
Figure 3B:
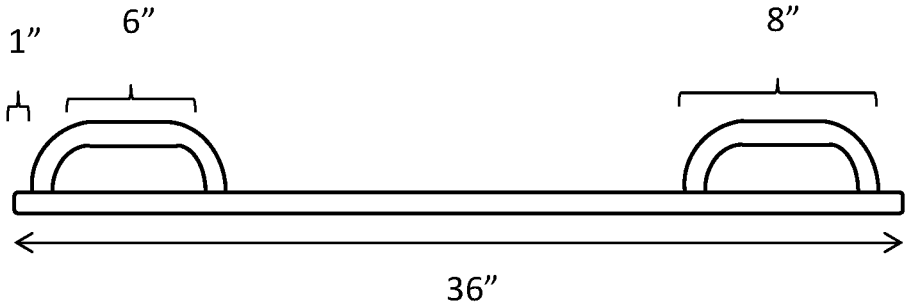
FIG. 3B is a side view of another weight lifting apparatus according to an embodiment of the present disclosure that is longer than the weight lifting apparatus illustrated in FIGS. 2A and 2B, and with exemplary dimensions labeled.

With reference to FIGS. 1A, 1B and 1C, an exemplary handle arrangement for the apparatus 100 is illustrated. In the embodiment, each handle may be spaced one inch from the nearest short side of the beam 102, while the handles 104 and 106 are spaced six inches apart along the same axis extending parallel to the long side of the beam 102. More specifically, the closest point at which the first handle 104 (i.e., the left handle) connects to the top side of the beam 102 is arranged one inch from a first short side of the beam 102 (i.e, the left short side), while the closest point at which the second handle 106 (i.e., the right handle) connects to the top side of the beam 102 is arranged one inch from a second short side of the beam 102 (i.e, the right short side). The handles 104 and 106 are further arranged six inches apart between the nearest points at which the first handle 104 and the second handle 106 connect with the top side of the beam 102. FIGS. 2A, 2B, 3A, 3B, 4A and 4B illustrate similar embodiments wherein only the distance between the handles change proportionately as the length of the apparatus increases. That is, the handles remain consistently spaced relative to the nearest short side of the beam as the length of the beam is increased, while the space between the handles increases proportionately as the length of the beam is increased.

The handles are located near (i.e., approximately or substantially one inch in FIGS. 1A, 1B, 1C, 2A, 2B, 3A, 3B, 4A and 4B) to the short sides of the beam to better allow the user to control the apparatus during exercises and to provide more function and utility for different types of exercises. A wide grip increases the user's control over the weight for certain exercises compared to traditional weight systems—such as dumbbells—that position most of the weight outside of the user's grip. In one exemplary use, someone exercising with the apparatus places the bottom side of the apparatus against their upper body while gripping the handles with their arms curled around the beam. Users can therefore balance an equal amount of weight across their entire upper body. This enables the user to be able to lift more weight, with greater ease and comfort, and to therefore increase the opportunity to add weight lifting into a fitness or recovery program.

For example, certain crunch exercises require a user to lays on their back with their knees bent, to then lift their shoulders and upper torso toward their knees and rotate to the left or right. If the 24 inch system depicted in FIG. 1 is used during the exercise, the user may hug the apparatus close to their body and not have to worry about the apparatus interfering in any way. If the user used a different, longer weight system, such as a barbell, the increased length of the bar being held would impact the floor and prevent the user from bending as far as necessary to correctly perform the exercise. At the same time, if the user was attempting to do the same exercise using a dumbbell or kettlebell, the awkward size and shape of the weight may make it more difficult to comfortably, and therefore correctly, perform the exercise.

Furthermore, users who are not as strong as those who use traditional weight systems, or that lack good balance, or that worry about their ability to lift traditional weights, may benefit from the more balanced weight of the present apparatus that allows them to work with more weight than they could otherwise. Increased control from a wide grip is also desirable for bodyweight workouts that can require a wide range of bodyweight motions such as standing, sitting, bending, and/or moving on the ground. For example, a user is naturally required to increase the width of their grip on the apparatus when holding the apparatus on their shoulders, with their arms stretched backward behind them, in order perform squat exercises.

FIGS. 1A, 1B, 1C, 2A, 2B, 3A, 3B, 4A and 4B illustrate generally similar weight lifting apparatuses that differ only in their length and weight. As the length of each apparatus is incrementally increased, the weight of each apparatus may be correspondingly increased. A weight lifting system may include a plurality of weight lifting apparatus of varying lengths and weights. The system may be designed to gradually increase a minimum-to-maximum amount of weight, with each successively longer apparatus being heavier than preceding shorter apparatuses. Apparatuses can be provided in different weights or lengths to provide a starter weight, which is then increased incrementally as the length of the apparatus is adjusted upward within the set. An apparatus can be constructed in which either or both of the length and weight of each apparatus differs by a constant amount from apparatus to apparatus in the progression of increasing apparatus size.

Figure 4A:
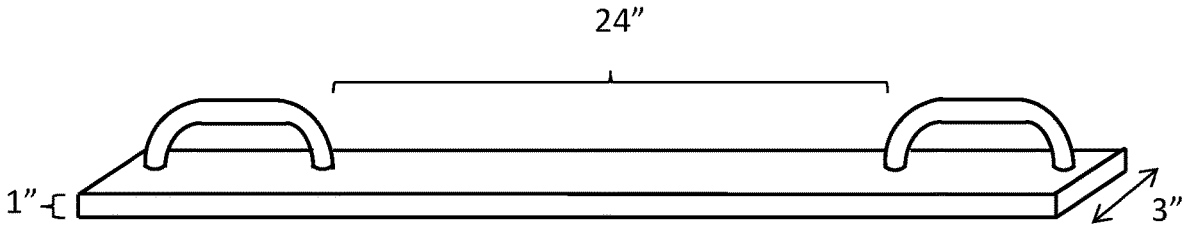
FIG. 4A is a perspective view of another weight lifting apparatus according to an embodiment of the present disclosure that is longer than the weight lifting apparatus illustrated in FIGS. 3A and 3B, and with exemplary dimensions labeled.
Figure 4B:
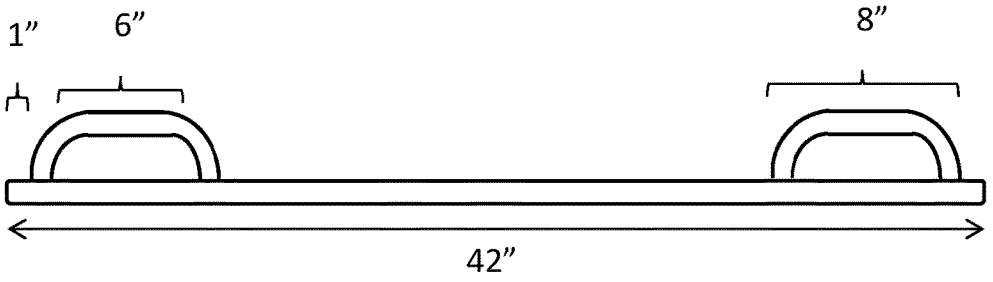
FIG. 4B is a side view of another weight lifting apparatus according to an embodiment of the present disclosure that is longer than the weight lifting apparatus illustrated in FIGS. 3A and 3B, and with exemplary dimensions labeled.

In one embodiment, the system could comprise four individual weight lifting apparatuses: one starter weight, two intermediate weights and one heavy weight. For example, such a system could include the four apparatuses shown in FIGS. 1A, 1B, 1C, 2A, 2B, 3A, 3B, 4A and 4B. The apparatus of FIGS. 1A, 1B and 1C could be the designated starter weight, with the system in FIGS. 4A and 4B the final and heaviest in the set. Other weight arrangements and variations are possible and included in the present disclosure, such as inconsistent increases in weight between each consecutive apparatus, larger numbers of apparatuses of lower or higher weights, and a series of apparatuses of the same length and width and thickness, but of different weights. In an embodiment, the apparatuses are made of iron or steel, but in embodiments, a variety of different alloys may be used to increase the weight variations based on the size, shape or intended use of the apparatuses. For example, FIGS. 4A and 4B show a 42 inch apparatus, but by varying the composition of the material used to make the beam, the apparatuses could have a variety of different weights. Likewise, the thickness or width could be increased in order to increase the weight of the apparatus without changing the length. It is also not necessary for each apparatus to have two handles, although that may help with heavier weights. Each apparatus could have a single handle, such as for smaller weights, or more than two handles in order for the apparatus to be used in some form of offset exercise where the weight is not evenly distributed relative to the user's body during an exercise.

Figure 5:
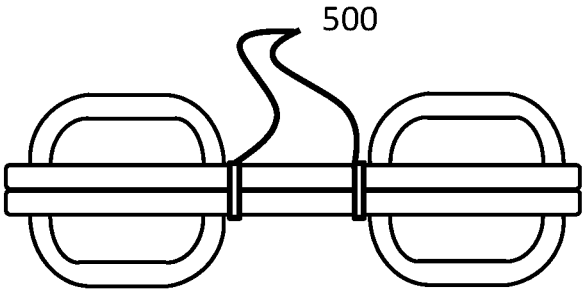
FIG. 5 is a side view of two weight lifting apparatus fitted back to back and held in place by a locking system.
Figure 6A:
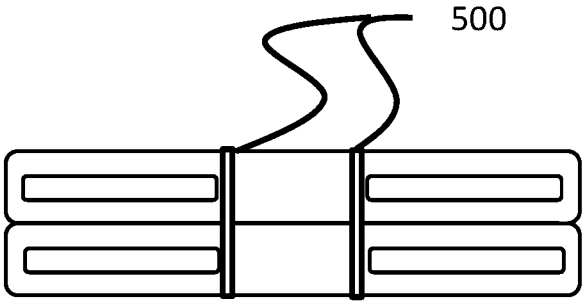
FIG. 6A is a top view of two weight lifting apparatus fitted side to side and held in place by a locking system.

In an embodiment, two or more apparatuses may be attached to one another so as to increase the weight of the apparatuses being used for a particular exercise. For example, as showing in FIG. 5, two apparatuses of the same size or of varying sizes may be placed back to back and then be fixed to one another so they remain attached during an exercise. This type of arrangement would create a four handled system that may be useful for certain exercises by an individual, or shared between two or more users. In another embodiment, as illustrated in FIG. 6A, two or more apparatuses may be placed side to side and then fixed to one another so they remain attached during an exercise. The structure required to fix the apparatuses to one another may vary. As shown in FIGS. 5 and 6A, straps 500 are used to fix each apparatus to one another. The straps 500 may be formed of an elastic material, such as a synthetic rubber, that will stretch around the handles, if placed on the inside of the handles as shown in FIGS. 5 and 6A, yet compress with enough strength to hold the apparatus together during use. The straps 500 may be place on ends of each beam so it is not necessary to stretch them over the handles. The straps 500 may also be formed of a hook and loop materials, such as VELCRO, or some other type of material that can be repeatedly applied and removed when needed.

Figure 6B:
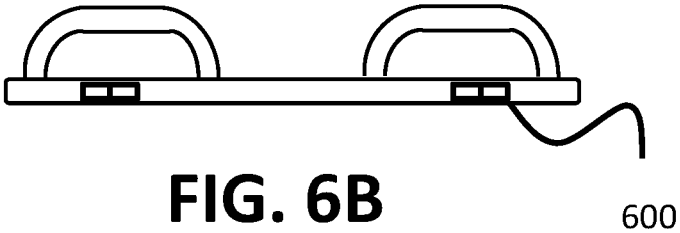
FIG. 6B is a side view of one of the weight lifting apparatuses of FIG. 6A illustrating interlocking joints of the locking system.

As shown in FIG. 6B, the apparatuses may also be fixed by a locking mechanism 600 within the beam 102, that enables the apparatuses to be fixedly joined together with or without requiring straps. For example, the locking mechanism 600 may be a tongue and groove type of arrangement where each locking mechanism includes a tongue that sticks our slightly so that it may engage with a groove in an opposing mechanism. In an embodiment, the two apparatuses may be positioned opposite one another, but slightly offset so that the tongue of one locking mechanism fits into the groove of the other locking mechanism, and then slid in opposite directions relative to one another so the tongue is locked within the groove until detached by moving them in the opposite direction. Adding straps may prevent the apparatuses from accidently unlocking during use. Other forms of locking mechanism may also be used, such as a mortise lock or some other form of lock. The locking mechanisms 600 may be on each side of the beam 102, on the bottom of the beam 102, or both the sides and bottom so that many different arrangements may be created.

In another embodiment, the system includes a starter apparatus with a weight of 12.5 pounds, and a heaviest apparatus with a weight of 21.5 pounds. The weight of the handles may or may not be taken into account when determining the overall weight factor of the apparatus. Because of the increased control and distribution of the weight as described above, the starting and end weights may be greater than what would be appropriate in dumbbells for the particular user. The number of apparatuses in a system set, the incremental increase in length and weight, and the start and end weights may all be varied. In particular, these factors may be varied depending on the exercises for which the system is likely to be used for, and for the likely users.

As noted, the weight lifting apparatuses may be made out of a metal such as iron or hollow aluminum, compressed fill (e.g., sand), or a combination of different materials. The handles may be integrally formed with the beam portion in a single mold, or may be separately attached after the beam portion is manufactured, such as by welds, and then coated and/or encased. Moreover, the weight lifting apparatus (i.e., the beam and the handles) may be wrapped in a plastic, neoprene, synthetic rubber, or some other appropriate coating and/or encasement. The apparatuses may also be colored to add an attractive element and to provide a color coding scheme that may be used to identify different weights or lengths in a set of systems.

Figures 7A, 7B:
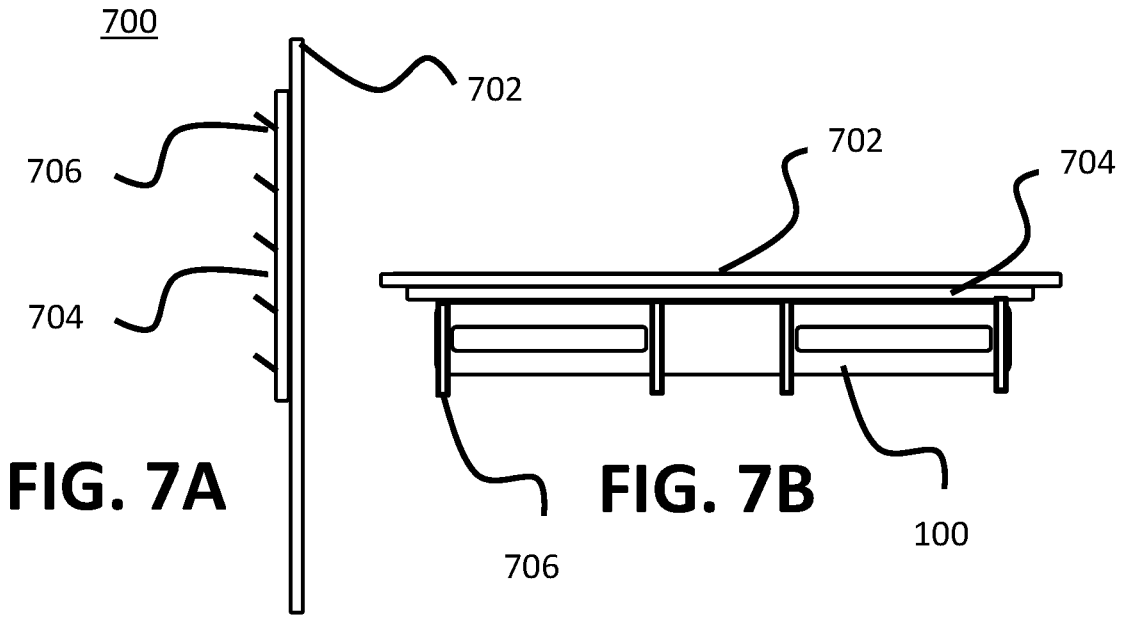
FIG. 7A is a side view of an adjustable rack for holding a plurality of weight lifting apparatuses.
FIG. 7B is a top view of the adjustable rack of FIG. 7A further illustrating a weight lifting apparatus held within the rack.

Each apparatus or a set of apparatuses may further be mounted on a rack, or stacked on a surface, in order to save space while not in use. For example, as illustrated in FIGS. 7A (side view) and 7B (top view), a rack 700 may be comprised of a stationary member 702, that may be attached to a vertical surface, such as a wall, and an adjustable member 704 that may move up or down relative to the stationary member 702. The mechanical arrangement between the adjustable member 704 and the stationary member 702 may include a chain mechanism, a sliding mechanism, a ratchet mechanism or some other type of mechanism that allows the systems 100 to be held in place by arms 706 and to be moved up or down relative to the user. The rack 700 may have a number of different forms or arrangements provided the rack 700 permits the system 100 to be raised and lowered relative to a user so the apparatus 100 is at a height appropriate for each exercise. For example, for some exercises where the user is using the apparatus 100 in front of them, it may be more convenient for the apparatus to be lower in the rack 700, but for other exercises, such as an exercise where the apparatus is held behind the shoulders, like for a squat, it may be more convenient for the apparatus to be higher in the rack 700, before the user grabs the apparatus 100 and removes it from the rack 700. By pulling on a chain, pull, release or other mechanism, the various apparatuses may be raised or lowered as needed.

Figure 8:
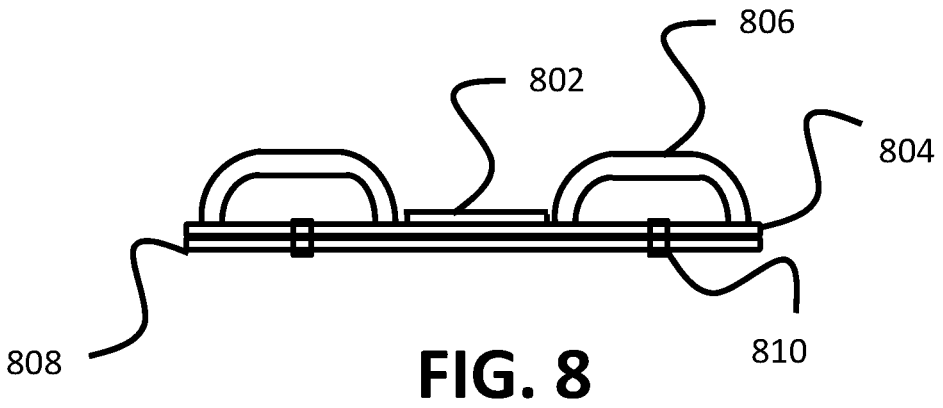
FIG. 8 is a side view of a weight lifting apparatus having a base configured to be attached to additional beams for changing the weight of the apparatus.

In a further embodiment, rather than have a separate apparatus with a beam and handles for each apparatus in a system of apparatuses, a single base with handles may be configured so that additional weights may be added to the base to change the overall weight of the apparatus. In an embodiment, as illustrated in FIG. 8, a base 802 of an apparatus 800 having a lowered area 804 in the areas of the handles 806 may result in the system 800 have an equally distributed weight along the length of the system 800 because the reduction in weight of the base 802 in the lowered areas 804 makes up for the added weight of the handles 806 such that when the system 800 is divided into thirds, a first area with a handle, a middle area, and a second area with a handle, are each of the same weight. This first configuration of the apparatus may represent the lowest weight of the system.

One or more additional beams 808, which may have a shape similar to the base 802, may then be added to the first configuration to create a second configuration of the system, so as to add additional weight. A first additional beam 808 may be attached to the base 802 by one or more locking mechanisms 810, which may take the form of straps, buckles, latches or any other form of attachment that will allow the user to recognize that the additional beam 808 is securely attached to the base 802 before lifting the apparatus 800 to perform an exercise. For example, the additional beam 808 may be connected to base 802 by the same type of locking mechanisms described above with respect to FIGS. 6A and 6B.

Further additional beams 808 (not shown, but substantially the same as additional beam 808 as illustrated in FIG. 8) may then be added to the first additional beam 808 by the same means and/or similarly attached to base 802 to create further configurations. In an embodiment, the total weight of each additional beam 808 may vary, such that a first additional beam has a first weight, a second additional beam has a second weight greater than the first weight, a third additional beam has a third weight greater than the second weight, etc., such that the weight of the system 800 may be increased without having to add multiple additional beams 808. Each of the first, second and third additional beams could vary in thickness or composition so as to account for the increase in weight from the first additional beam to the second additional beam and to the third additional beam.

Figure 9:
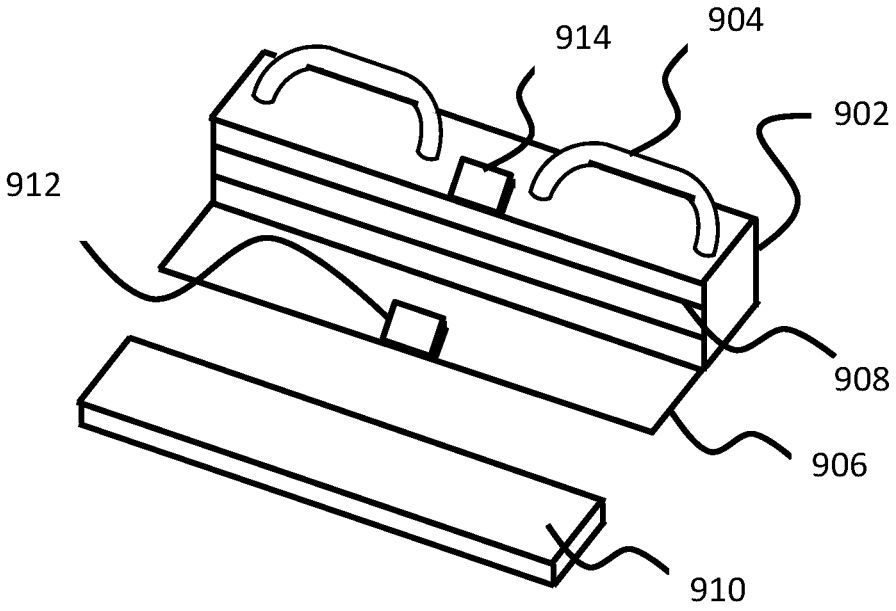
FIG. 9 is a perspective view of a weight lifting apparatus having a base forming a box with one or more shelves for holding additional beams for changing the weight of the apparatus.

Another embodiment of an apparatus 900 is illustrated in FIG. 9, in which a base 902 has handles 904 and a door 906. Within the base 902 are a number of shelves or sliding areas 908 within which additional beams 910 may be inserted. As illustrated, base 902 has three shelves or sliding areas to as to accommodate three different additional beams 910. The base 902 may result in a first weight of the apparatus, equally distributed or substantially equally distributed along its length, or not, and the addition of an additional beam 910 to the base 902 may result in a second weight. Closing the door 906 and affixing first latch 912 to second latch 914 may result in securely holding the additional beam 910 within the shelf 908 of the base 902, such that an exercise may be performed with the apparatus 900 without having the additional beam 910 falling out of the base 902. Further additional beams 910 may be added to the base 902 to create third weight, a fourth weight, etc., of the apparatus 900. The additional beams 910 could also be formed of materials of different weights so that only one additional weight need be added to base 902 to create the second, third and fourth weights. For example, a first additional beam may add three pounds, a second additional beam may add six pounds, while a third additional beam may could add nine pounds, such that each additional beam may result in the total weight of the apparatus increasing from 12.5 pounds (with no additional beam) to 15.5 pounds, 18.5 pounds and 21.5 pounds. Naturally, a wide variation of additional beams may be used to create any combination of weight variations for the system 900 such that the single apparatus may form the weight system.

In addition to the embodiments discussed above, it may be appreciated that there are various alterations, modifications, and improvements. For instance, the specific choice of materials with respect to the various components are within the ability of those skilled in the art according to the application, based on the functional indications given above. The specification and drawings are, accordingly, to be regarded in an illustrative rather than a restrictive sense. It will, however, be evident that various modifications and changes may be made thereunto without departing from the broader spirit and scope of the invention.

What is claimed:

1. A weight lifting apparatus, comprising:

a distributed weight base configured to be lifted by a user during performance of a weight lifting exercise, the distributed weight base including:

a beam having a length, a width, a thickness, and a weight, wherein the width is less than the length, the beam including a top side and a bottom side each defined by the width and the length of the beam, wherein the top side is substantially opposite the bottom side, a first short side and a second short side each defined by the thickness and the width of the beam, wherein the first short side is substantially opposite the second short side, and a first long side and a second long side defined by the thickness and the length of the beam, wherein the first long side is substantially opposite the second long side; and a first handle and a second handle non-movably connected to the top side and at least a portion of the first handle and second handle extending above an uppermost portion of the top side, wherein the first handle and the second handle are arranged substantially collinearly along an axis substantially parallel to the length, wherein the first handle is arranged nearer to the first short side than the second handle and the second handle is arranged nearer the second short side than the first handle, wherein a first distance between the first handle and the second handle along the axis is greater than a second distance from the first short side to the first handle and also greater than a third distance from the second short side to the second handle, and wherein the beam, the first handle, and the second handle are integrally formed from a single mold.

2. The weight lifting apparatus of claim 1, wherein the axis along which the first handle and the second handle are arranged is substantially equidistant to both the first long side and the second long side.

3. The weight lifting apparatus of claim 1, wherein the beam, the first handle, and second handle are comprised of the same material.

4. The weight lifting apparatus of claim 1, wherein each of the first handle and the second handle includes a grip having a first end and a second end, a first bend having a first end coupled to the first end of the grip and a second end connected to the beam, and a second bend having a first end coupled to the second end of the grip and a second end connected to the beam, wherein the grip is substantially parallel to the length.

5. The weight lifting apparatus of claim 1, further comprising a locking mechanism configured to attach the beam to a second beam having substantially the same physical configuration as the beam.

6. The weight lifting apparatus of claim 5, wherein the locking mechanism is on the bottom side of the beam.

7. The weight lifting apparatus of claim 5, wherein the locking mechanism is on at least one of the first long side and the second long side.

8. The weight lifting apparatus of claim 5, wherein the locking mechanism is a strap.

9. The weight lifting apparatus of claim 5, wherein the beam, the first handle and the second handle are coated in one of a plastic, a neoprene, a synthetic rubber, or a resilient soft coating.

10. The weight lifting apparatus of claim 1, wherein the weight of the beam is substantially equally distributed along the length of the beam.

11. The weight lifting apparatus of claim 1, wherein the thickness of the beam along the first distance is greater than the thickness of the beam under at least the first handle and the second handle, such that a combined weight of the beam, the first handle and the second handle is substantially equally distributed along the length.

12. A weight lifting system, comprising:

a series of apparatuses, each apparatus comprising a distributed weight base configured to be lifted by a user during performance of a weight lifting exercise, the distributed weight base including:

a beam having a length, a width, a thickness, and a weight, wherein at least the weight of each beam is different, wherein the width of each beam is less than the length of each beam, each beam including a top side and a bottom side each defined by the width of each beam and the length of each beam, wherein the top side is substantially opposite the bottom side, wherein the top side of each beam is substantially opposite the bottom side of each beam, a first short side of each beam and a second short side of each beam each defined by the thickness of each beam and the width of each beam, wherein the first short side of each beam is substantially opposite the second short side of each beam, and a first long side of each beam and a second long side of each beam defined by the thickness of each beam and the length of each beam, wherein the first long side of each beam is substantially opposite the second long side of each beam; and a first handle and a second handle non-movably connected to the top side and at least a portion of the first handle and second handle extending above an uppermost portion of the top side of each beam, wherein the first handle and the second handle are arranged substantially collinearly along an axis of each beam substantially parallel to the length of each beam, wherein the first handle is arranged nearer to the first short side of each beam than the second handle and the second handle is arranged nearer the second short side of each beam than the first handle, and wherein a first distance between the first handle and the second handle along the axis of each beam is greater than a second distance from the first short side of each beam to the first handle and also greater than a third distance from the second short side of each beam to the second handle, and wherein each beam, the first handle of each apparatus, and the second handle of each apparatus are integrally formed from a single mold.

13. The weight lifting system of claim 12, wherein the axis of each beam along which the first handle of each beam and the second handle of each beam are arranged is substantially equidistant to both the first long side of each beam and the second long side of each beam.

14. The weight lifting system of claim 12, wherein each beam, the first handle of each apparatus, and second handle of each apparatus are comprised of the same material.

15. The weight lifting system of claim 12, wherein each of the first handle of each apparatus and the second handle of each apparatus includes a grip portion and one or more connector portions, wherein the grip portion is substantially parallel to the length of each beam and wherein the one or more connector portions connect substantially perpendicular to each beam.

16. The weight lifting system of claim 12, further comprising a locking mechanism configured to attach each beam to another beam or each apparatus to another apparatus in the series of apparatuses.

17. The weight lifting system of claim 16, wherein the locking mechanism is on the bottom side of each beam.

18. The weight lifting system of claim 16, wherein the locking mechanism is on at least one of the first long side of each beam and the second long side of each beam.

19. The weight lifting system of claim 16, wherein the locking mechanism is a strap.

20. The weight lifting system of claim 16, wherein each beam, the first handle of each apparatus, and the second handle of each apparatus are coated in one of a plastic, a neoprene, a synthetic rubber, or a resilient soft coating.

21. The weight lifting system of claim 12, wherein the length of each beam is proportional to the weight of each beam.

22. The weight lifting system of claim 12, wherein the series of beams includes a first beam, a second beam, a third beam and a fourth beam, wherein the first beam has a length configured for a first exercise, wherein the second beam has a length configured for a second exercise, wherein the third beam has a length configured for a third exercise, wherein the fourth beam has a length configured for a fourth exercise.

23. The weight lifting system of claim 12, wherein each beam in the series of apparatuses has the same width and thickness.

24. The weight lifting system of claim 12, wherein each apparatus in the series of apparatus varies at least by one of the length of each beam or the weight of each beam from a prior apparatus or a subsequent apparatus in the series of apparatuses by a constant amount.

25. The weight lifting system of claim 12, further comprising a rack for holding the series of apparatuses, the rack having a stationary member and an adjustable member, wherein the series of apparatuses is supported by the adjustable member and wherein the adjustable member moves vertically relative to the stationary member.

26. The weight lifting apparatus of claim 12, wherein the weight of each beam is substantially equally distributed along the length of each beam.

27. The weight lifting apparatus of claim 12, wherein the thickness of each beam along the first distance of each beam is greater than the thickness of each beam under at least the first handle and the second handle, such that a combined weight of each beam, the first handle and the second handle is substantially equally distributed along the length of each beam.

28. A weight lifting apparatus, comprising:

a distributed weight base configured to be lifted by a user during performance of an exercise, the distributed weight base including:

a first length, a first width, a first thickness, and a first weight, wherein the first width is less than the first length, the base including a top side and a bottom side each defined by the first width and the first length of the beam, wherein each of the top side and the bottom side are planar surfaces, wherein the top side of the base is substantially opposite the bottom side of the base, a first short side and a second short side each defined by the first thickness and the first width of the base, wherein the first short side is substantially opposite the second short side, and a first long side and a second long side defined by the first thickness and the first length of the base, wherein the first long side is substantially opposite the second long side;

a first handle and a second handle non-movably connected to the planar surface of the top side of the base, wherein the first handle and the second handle are arranged substantially collinearly along an axis of the base substantially parallel to the first length, wherein the first handle is arranged nearer to the first short side than the second handle and the second handle is arranged nearer the second short side than the first handle, and wherein a first distance between the first handle and the second handle along the base axis is greater than a second distance from the first short side to the first handle and also greater than a third distance from the second short side to the second handle; and a beam having a second length, a second width, a second thickness and a second weight, the beam being configured for combining with the base to increase an overall weight of the apparatus.

29. The weight lifting apparatus of claim 28, further comprising a locking mechanism configured to securely attach the beam to the base.

30. The weight lifting apparatus of claim 28, further comprising one or more additional beams configured to be securely attached to the beam, each of the one or more additional beams having a third weight substantially the same as the second weight.

31. The weight lifting apparatus of claim 28, further comprising two or more additional beams including a first additional beam having a third weight greater than the second weight and a second additional beam having a fourth weight greater than the third weight, wherein each additional beam among the two or more additional beams is configured to be securely attached to the first beam.

32. The weight lifting apparatus of claim 28, wherein the top side of the base, the bottom side of the base, the first short side, the second short side, the first long side and the second long side form a box, the weight lifting apparatus further comprising at least one shelf in the box dividing an inside of the box into two or more areas, wherein the beam is configured to fit within at least one of the two or more areas, and wherein at least one of the first short side, the second short side, the first long side, or the second long side forms a lid configured to safely retain the beam inside the box when the weight lifting apparatus is used for an exercise.

33. The weight lifting apparatus of claim 32, further comprising one or more additional beams configured to fit within at least one of the two or more areas.

34. The weight lifting apparatus of claim 32, further comprising one or more hinges configured to connect the lid to the bottom side of the base and one or more latches configured to securely affix the lid to the top side of the base.

* * * * *